US005860874A

United States Patent [19]

Wateska et al.

[11] Patent Number: 5,860,874

[45] Date of Patent: Jan. 19, 1999

[54] GOLFER'S SWING TRAINING DEVICE

[76] Inventors: John E. Wateska, 3048 Meadow Brook Ct., Gibsonia, Pa. 15044; Greg J. Jacobs, 554 Bethany Dr., Pittsburgh, Pa. 15215

[21] Appl. No.: 974,243

[22] Filed: Nov. 19, 1997

[51] Int. Cl.[6] ..... A63B 69/36

[52] U.S. Cl. ..... 473/263; 473/146

[58] Field of Search ..... 473/139, 145, 473/146, 263

[56] References Cited

U.S. PATENT DOCUMENTS

| | | | |
|---|---|---|---|
| 3,510,136 | 5/1970 | Ruspoli | 273/185 |
| 3,550,946 | 12/1970 | Menendez | 473/218 |
| 4,508,340 | 4/1985 | Liao | 473/145 X |
| 5,215,306 | 6/1993 | Cayce | 273/186.1 |
| 5,263,719 | 11/1993 | Bunn | 273/186.1 |
| 5,346,220 | 9/1994 | Cooper et al. | 273/191 R |
| 5,421,579 | 6/1995 | Webele, Jr. | 273/191 |
| 5,433,445 | 7/1995 | Melancon | 273/186.1 |
| 5,513,842 | 5/1996 | Fuss | 473/263 |
| 5,520,391 | 5/1996 | Howe | 473/265 |
| 5,577,964 | 11/1996 | Chen | 473/145 |

*Primary Examiner*—George J. Marlo
*Attorney, Agent, or Firm*—David L. Volk

[57] ABSTRACT

An arm structure comprises a first arm and a second arm. The first arm is attached to a base and extends generally upwardly therefrom, while being pivotable about an axis perpendicular to its elongated axis. The second arm extends horizontally outwardly from the first arm. A height of a distal end of the second arm above the base is adjustable. The arm structure is configured such that when the second arm is struck by a swinging golf club, the second arm automatically returns generally to the position relative to the base which it had immediately prior to being struck.

In one embodiment, a resilient sleeve extends outwardly from a distal end of the second leg. In another embodiment, opposing first and second sleeves are provided at a juncture of the first and second legs. The second sleeve has an elliptically shaped surface adjacent an elliptically shaped surface of the first sleeve.

7 Claims, 5 Drawing Sheets

GOLFER'S SWING TRAINING DEVICE

BACKGROUND OF THE INVENTION

1. Field of the Invention

The present invention relates to golfer's training devices.

2. Description of the Related Art

A long, wide, sweeping arc is optimum for a golfer's swing. Such a swing creates better club head speed. A common deficiency is the hurrying and shortening of a swing, and the narrowing of the arc of the swing. This deficiency can occur on the back swing as well as the down swing.

Another deficiency occurs when the swing is not maintained in a proper swing plane. This problem is commonly referred to as swinging over the top.

No golfer's training aid has been developed which is as simple, inexpensive, easy to use and effective as the present invention, for helping a golfer to develop and maintain a long, wide, sweeping arc in his or her swing, and for maintaining a proper swing plane.

SUMMARY OF THE INVENTION

The golfer's swing training device of the present invention includes an arm structure comprising a first arm and a second arm. The first arm is attached to a base and extends generally upwardly therefrom. The second arm extends outwardly from the first arm. A height of a distal end of the second arm above the base is adjustable. The arm structure is configured such that when the second arm is struck by a swinging golf club, the second arm automatically returns generally to the position relative to the base which it had immediately prior to being struck.

To use the device, a right handed golfer positions the base on the ground slightly to the right of the right foot, in front of the golfer. The height of the distal end of the second arm is adjusted. The golfer then swings his or her club such that the club head passes beneath the second arm on the back swing and on the forward swing. If the golfer inadvertently hits the second arm, the second arm automatically returns generally to the position relative to the base which it had immediately prior to being struck, and is ready immediately for use again.

Because the height of the distal end of the second arm is adjustable, the device can be used with clubs of various sized heads, and tees at various heights.

Because the second arm returns to the position which it had prior to being struck, it is immediately ready for repeated use.

Still further features and advantages will become apparent from the ensuing description and drawings.

DETAILED DESCRIPTION

Figure 1:
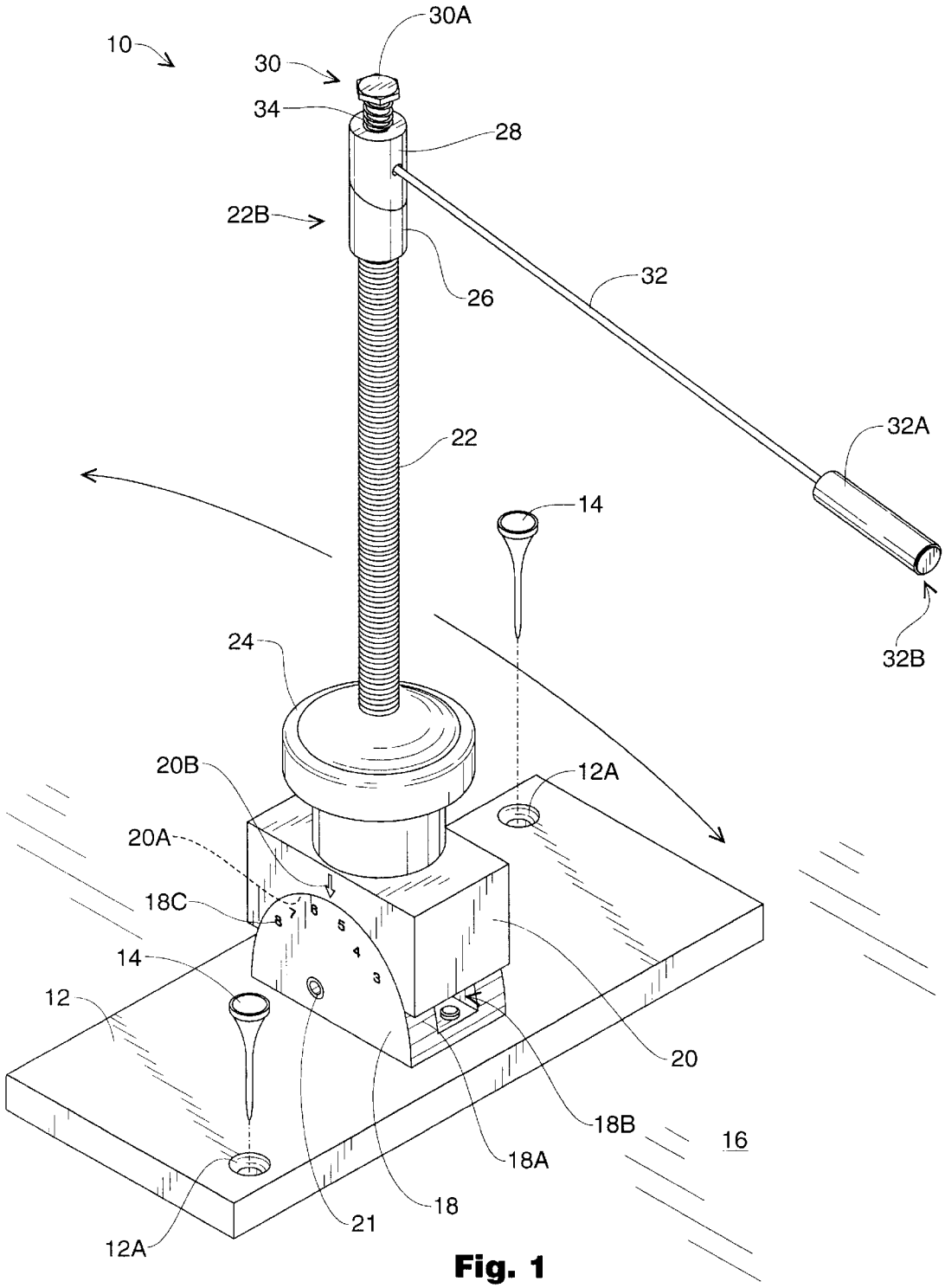
FIG. 1 is a perspective view of a first embodiment of a golfer's swing training device of the present invention.
Figure 2:
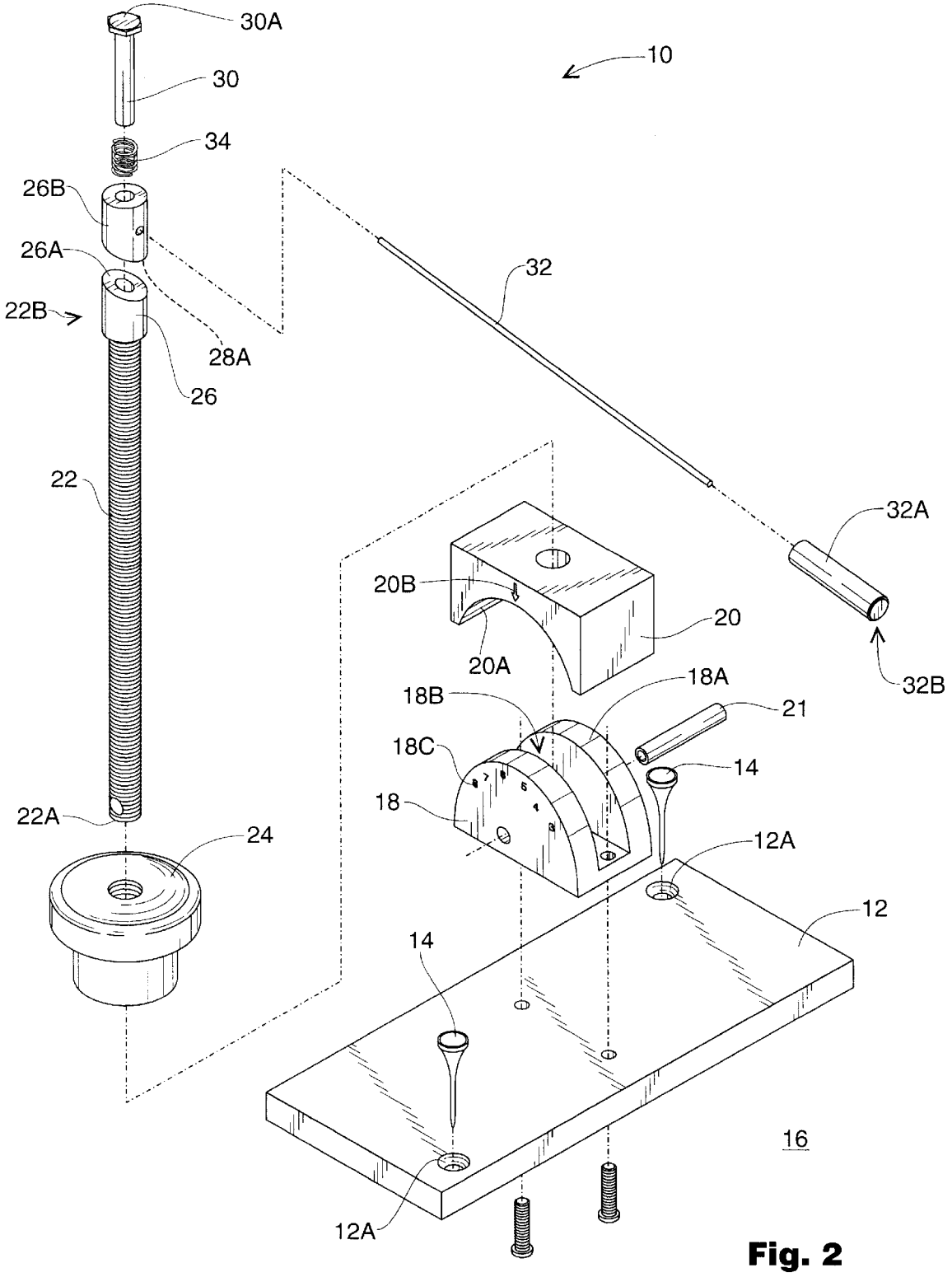
FIG. 2 is an exploded perspective view of the first embodiment of the device.

FIG. 1 is a perspective view of a first embodiment of a golfer's swing training device 10 of the present invention. FIG. 2 is an exploded perspective view of the first embodiment of the device 10. Referring to FIGS. 1 and 2, the device 10 includes a generally planar main base 12. The main base 12 includes at least one aperture 12A therein, adapted for a golf tee 14 to be inserted there-through, for anchoring the main base 12 to ground 16.

A pivot base 18 is mounted to the main base 12. The pivot base 18 has an outwardly arcuate face 18A, and structure forming a slot 18B disposed along the outwardly arcuate face 18A. A gliding block 20 having an inwardly arcuate face 20A is configured to engage the outwardly arcuate face 18A of the pivot base 18.

A threaded first arm 22 extends through the slot 18B and through the gliding block 20, and has a first arm first end 22A and a first arm second end 22B. The first arm 22 is pivotally attached to the pivot base 18 at the first arm first end 22A. The first arm 22 is mounted by a pivot pin 21 to the pivot base 18, such that the first arm 22 pivots with respect to the pivot base 18 in the directions indicated by the arrows.

A wheel 24 is threadedly adjustable along the first arm 22 between the gliding block 20 and the first arm second end 22B. The first arm 22 becomes fixed with respect to the main base 12 when the wheel is 24 threadedly adjusted downward against the gliding block 20 to urge the gliding block 20 against the pivot base 18.

A first sleeve 26 is attached to the first arm second end 22B, such that a longitudinal axis of the first sleeve 26 is collinear with a longitudinal axis of the first arm 22. The first sleeve 26 has an elliptically shaped first sleeve end surface 26A forming a non-perpendicular angle with respect to the longitudinal axis of the first sleeve 26.

A second sleeve 28 is mounted adjacent to the first sleeve 26, such that a longitudinal axis of the second sleeve 28 is collinear with the longitudinal axis of the first sleeve 26. The second sleeve 28 has an elliptically shaped second sleeve end surface 28A adjacent the first sleeve end surface 26A. A pin 30 extends through the second sleeve 28 along the longitudinal axis of the second sleeve 28.

A second arm 32 extends outwardly from the second sleeve 28, and includes an enlarged end 32A for heightened visibility. The height of a distal end 32B of the enlarged end 32A above the ground 16 is adjustable by pivoting the first arm 22 with respect to the main base 12, in the direction shown by the arrows in FIG. 1.

To adjust the height of the distal end 32B, the wheel 24 is first loosened to permit the gliding block 20 to glide along the pivot base 18. The first arm 22 is pivoted by hand until the distal end 32B is at the desired height. Then the wheel 24 is tightened against the gliding block 20 to lock the first arm 22 in place.

The gliding block 20 may include a pointer 20B, configured to point to numbers 18C on the pivot base 18. The pointer 20B aligns with each of the numbers 18C to indicate the height of the distal end 32B above the ground 16.

Figure 3:
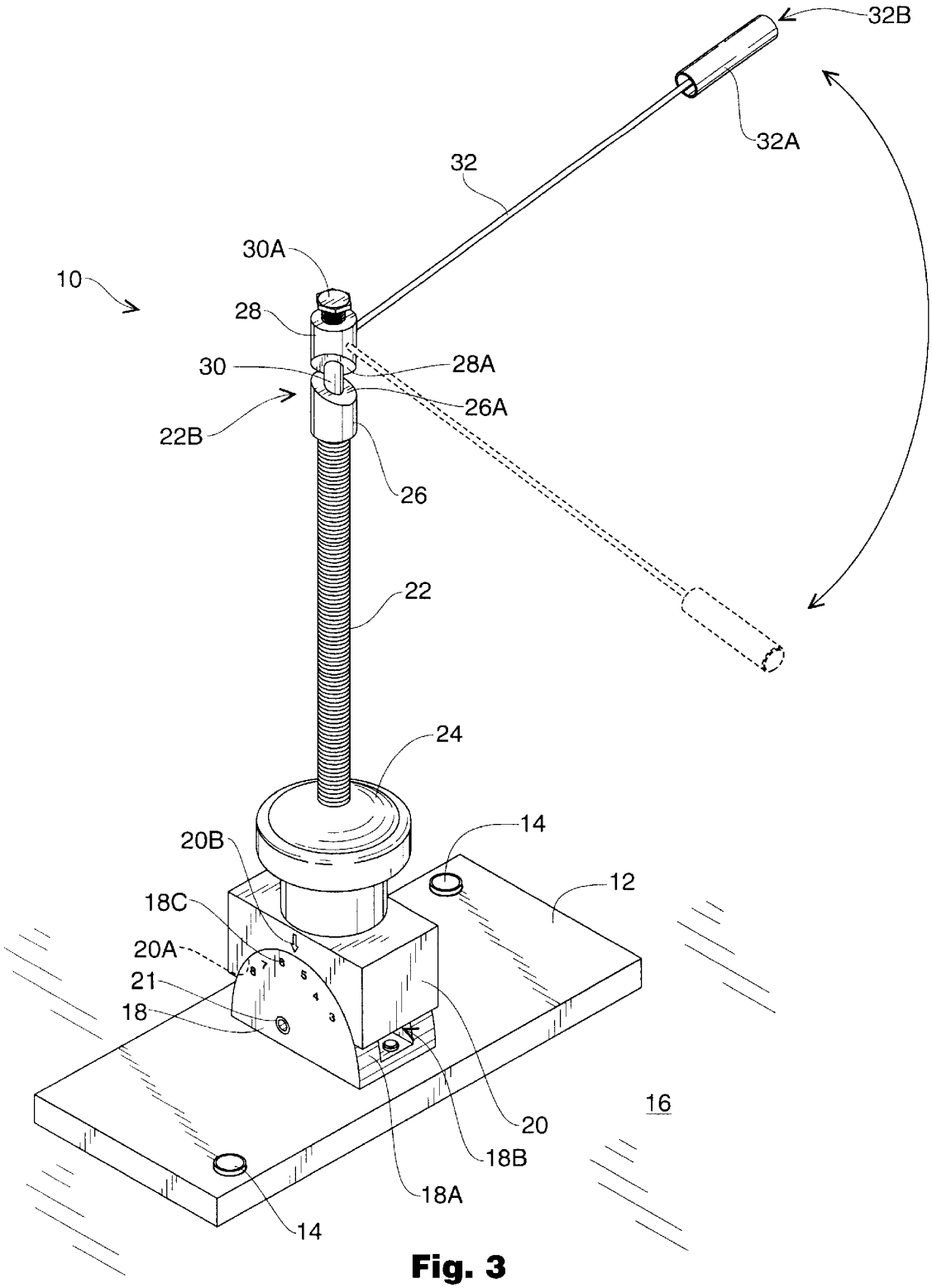
FIG. 3 is a perspective view of the first embodiment of the first embodiment of the device in use, showing the manner in which the second arm returns to its original position after being struck.

FIG. 3 is a perspective view of the first embodiment of the device 10 in use. Referring to FIGS. 1 and 3, the second sleeve 28 is rotatable about the pin 30. The pin 30 has a cap 30A on a distal end thereof, and a spring 34 disposed between the cap 30A and the second sleeve 28. The spring 34 acts to urge the second sleeve 28 against the first sleeve 26 such that the second sleeve end surface 28A aligns with the first sleeve end surface 26A.

In FIG. 3, the second arm 32 shown in solid line, indicates the position of the second arm 32 immediately after being struck from the left by a golf club (not shown). The second arm 32 is also free to rotate in the opposite direction when struck from the right.

The dotted line showing of the second arm 32 shows the position of the second arm 32 before being struck, which is the same as the position shown in FIG. 1. This is also the position which the second arm 32 resumes due to the action of the spring 34 to urge the second sleeve 28 against the first sleeve 26 such that the second sleeve end surface 28A aligns with the first sleeve end surface 26A.

Figure 4:
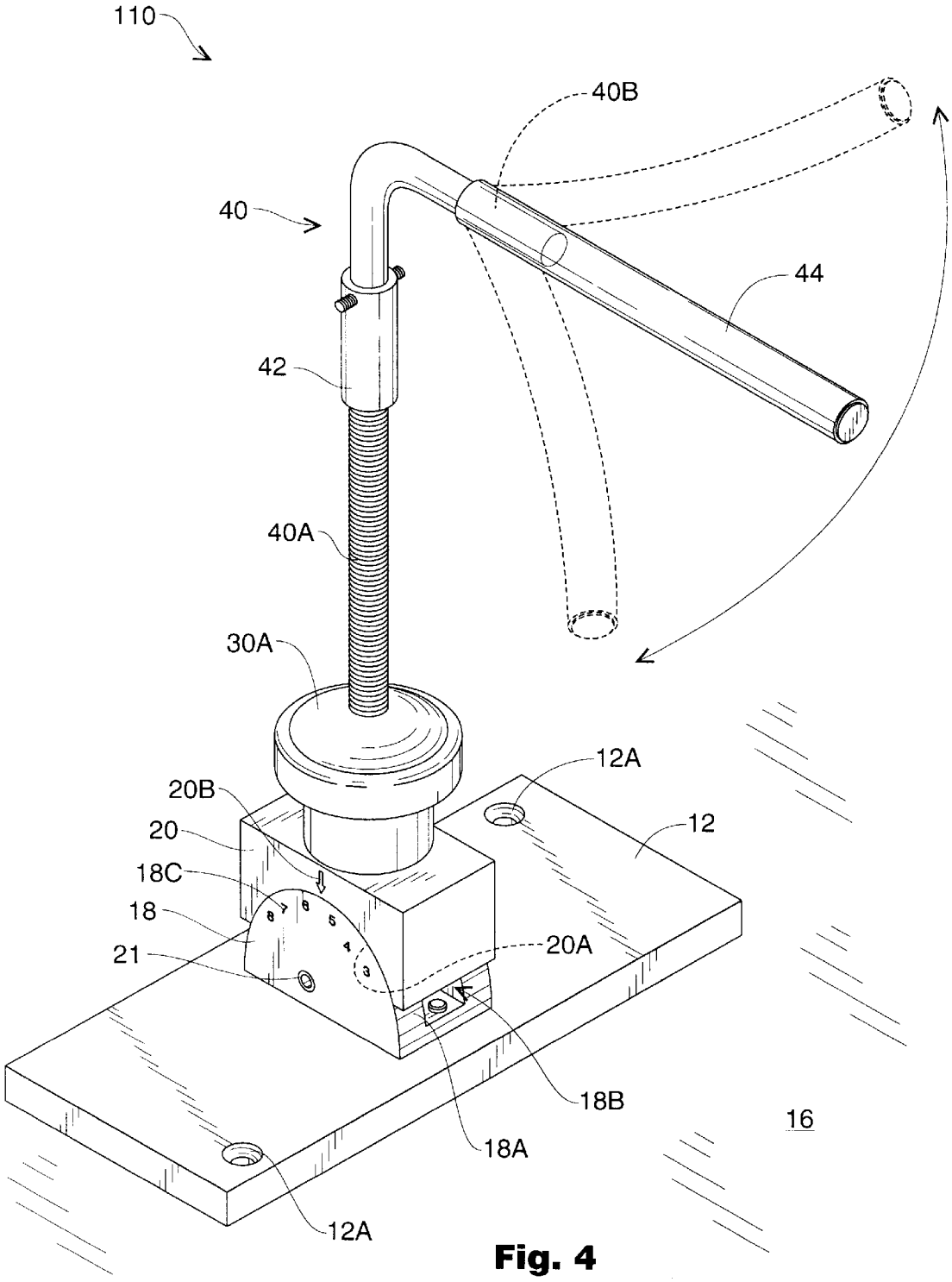
FIG. 4 is a perspective view of a second embodiment of the golfer's swing training device.

FIG. 4 is a perspective view of a second embodiment of the device 110. The main base 12, pivot base 18, and gliding block 20 are configured the same as for the first embodiment of the device 10.

The first arm 22 and the second arm 32 of the first embodiment are replaced by an elongate member 40 curving to form a first leg 40A and a second leg 40B. Although the elongate member 40 shown in this figure is actually two separate parts connected by a connecting sleeve 42, it is within the scope of the present invention that the elongate member 40 may be a single member which comprises both the first leg 40A and the second leg 40B.

In a similar manner to the first embodiment, the first leg 40A is threaded and extends through the slot 18B of the pivot base 18, and through the gliding block 20. Also in a similar manner to the first embodiment, the first leg 40A is pivotally attached to the pivot base 18 at a distal end of the first leg 40A.

Also, in a similar manner to the first embodiment, a wheel 24 is threadedly adjustable along the first leg 40A, and the first leg 40A becomes fixed with respect to the main base 12 when the wheel 24 is threadedly adjusted against the gliding block 20 to urge the gliding block 20 against the pivot base 18.

A terminal sleeve 44 extends outwardly from a distal end of the second leg 40B, a longitudinal axis of the terminal sleeve 44 being collinear with a longitudinal axis of the second leg 40B. The terminal sleeve 44 is resilient, so that when a distal end of the terminal sleeve 44 is struck by a golf club (not shown), the terminal sleeve 44 springs back generally to a position held immediately prior to being struck by the golf club.

In FIG. 4, the dotted line showings of the terminal sleeve 44 show the positions of the terminal sleeve 44 after the terminal sleeve has been struck from either end. The terminal sleeve 44 then springs back to the position indicated by the solid line showing of the terminal sleeve 44.

Figure 5:
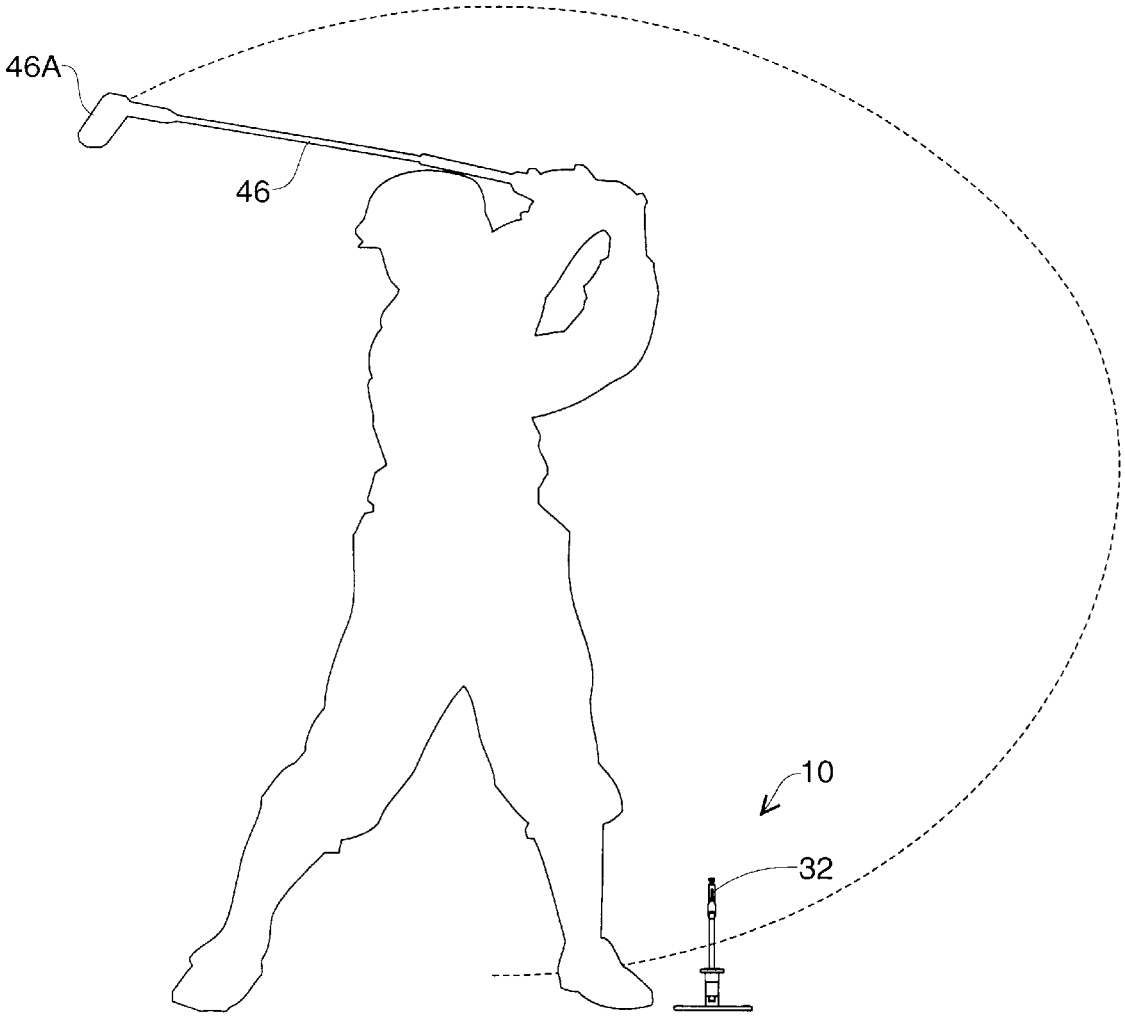
FIG. 5 is an elevational view of the device in use, showing the placement of the device and indicating the swing of the golf club such that the head moves beneath the second arm.

FIG. 5 is an elevational view of the device 10 in use, showing the placement of the device 10 and indicating the swing of a golf club 46 such that a head 46A of the golf club 46 moves beneath the second arm 32.

The foregoing description is included to describe embodiments of the present invention which include the preferred embodiment, and is not meant to limit the scope of the invention. From the foregoing description, many variations will be apparent to those skilled in the art that would be encompassed by the spirit and scope of the invention. Accordingly, the scope of the invention is to be limited only by the following claims and their legal equivalents.

The invention claimed is:

1. A golfer's swing training device comprising:

a. a main base;

b. a first arm extending upwardly from the main base, and having a first arm first end positioned near the main base and fixedly secured thereto and a first arm second end above the first arm first end;

c. a pivot means for pivoting the first arm with respect to the main base about an axis which is perpendicular to a longitudinal axis of the first arm and which passes through the first arm near the first arm first end;

d. a second arm extending outwardly from the first arm second end and being displacable relative thereto in a generally horizontal plane, generally parallel to said main base; and e. a return means for urging the second arm, after being struck by a golf club, to return to the generally horizontal position held by the second arm immediately prior to being struck and displaced by the golf club.

2. The device of claim 1, wherein the return means comprises:

a. a first sleeve attached to the first arm second end, a longitudinal axis of the first sleeve being collinear with a longitudinal axis of the first arm;

b. the first sleeve having an elliptically shaped first sleeve end surface forming a non-perpendicular angle with respect to the longitudinal axis of the first sleeve;

c. a second sleeve mounted adjacent to the first sleeve, a longitudinal axis of the second sleeve being collinear with the longitudinal axis of the first sleeve;

d. the second sleeve having an elliptically shaped second sleeve end surface adjacent the first sleeve end surface;

e. a pin extending through the second sleeve along the longitudinal axis of the second sleeve, the second sleeve being rotatable about the pin;

f. the pin having a cap on a distal end thereof, and a spring disposed between the cap and the second sleeve, the spring acting to urge the second sleeve against the first sleeve such that the second sleeve end surface aligns with the first sleeve end surface; and g. the second arm extends outwardly from the second sleeve.

3. The device of claim 2, wherein the main base is generally planar, and the pivot means comprises:

a. a pivot base mounted to the main base and having an outwardly arcuate face;

b. structure forming a slot disposed along the outwardly arcuate face;

c. a gliding block having an inwardly arcuate face configured to engage the outwardly arcuate face of the pivot base;

d. the first arm being threaded and extending through the slot and through the gliding block;

e. the first arm being pivotally attached to the pivot base at the first arm first end;

f. a wheel threadedly adjustable along the first arm between the gliding block and the first arm second end; and g. the first arm becoming fixed with respect to the main base when the wheel is threadedly adjusted against the gliding block to urge the gliding block against the pivot base.

4. The device of claim 3, wherein the main base includes at least one aperture therein, adapted for a golf tee to be inserted there-through, for anchoring the main base to ground.

5. The device of claim 1, wherein the return means comprises:

a. a sleeve extending outwardly from a distal end of the second leg, a longitudinal axis of the sleeve being collinear with a longitudinal axis of the second leg; and b. the sleeve being resilient such that when a distal end of the sleeve is struck by the golf club, the sleeve springs back generally to a position held immediately prior to being struck by the golf club.

6. The device of claim 5, wherein the main base is generally planar, an elongate member curves to form the first leg and the second leg, and the pivot means comprises:

a. a pivot base mounted to the main base and having an outwardly arcuate face;

b. structure forming a slot disposed along the outwardly arcuate face;

c. a gliding block having an inwardly arcuate face configured to engage the outwardly arcuate face of the pivot base;

d. the first leg being threaded and extending through the slot and through the gliding block;

e. the first leg being pivotally attached to the pivot base at the first arm first end;

f. a wheel threadedly adjustable along the first leg; and g. the first leg becoming fixed with respect to the main base when the wheel is threadedly adjusted against the gliding block to urge the gliding block against the pivot base.

7. The device of claim 6, wherein the main base includes at least one aperture therein, adapted for a golf tee to be inserted there-through, for anchoring the main base to ground.

* * * * *